US008899825B2

(12) United States Patent
Denize et al.

(10) Patent No.: US 8,899,825 B2
(45) Date of Patent: Dec. 2, 2014

(54) STIRRER DEVICE AND A METHOD OF ADJUSTING IT

(75) Inventors: Cyril Denize, Chartres (FR); Aurelien Brule, Chartres (FR)

(73) Assignee: Fillon Technologies, Faverolles (FR)

( * ) Notice: Subject to any disclaimer, the term of this patent is extended or adjusted under 35 U.S.C. 154(b) by 1017 days.

(21) Appl. No.: 13/000,162

(22) PCT Filed: Jun. 17, 2009

(86) PCT No.: PCT/FR2009/051150

§ 371 (c)(1),
(2), (4) Date: Dec. 20, 2010

(87) PCT Pub. No.: WO2009/153522

PCT Pub. Date: Dec. 23, 2009

(65) Prior Publication Data

US 2011/0103177 A1 May 5, 2011

(30) Foreign Application Priority Data

Jun. 20, 2008 (FR) ..... 08 03444

(51) Int. Cl.

| | |
|---|---|
| ***B01F 7/16*** | (2006.01) |
| ***B01F 7/00*** | (2006.01) |
| ***B01F 15/00*** | (2006.01) |
| *B01F 13/00* | (2006.01) |

(52) U.S. Cl.

CPC ..... *B01F 7/1695* (2013.01); *B01F 7/00716* (2013.01); *B01F 15/00707* (2013.01); *B01F 13/002* (2013.01); *B01F 2015/00603* (2013.01); *B01F 2215/005* (2013.01); *Y10S 366/605* (2013.01)

USPC ..... 366/286; 366/293; 366/343; 366/605

(58) Field of Classification Search

CPC ..... B01F 7/0085; B01F 7/00858

USPC ..... 366/285, 293–296, 308, 343, 286

See application file for complete search history.

(56) References Cited

U.S. PATENT DOCUMENTS

| | | | | |
|---|---|---|---|---|
| 825,897 | A * | 7/1906 | Fay | 366/285 |
| 861,603 | A * | 7/1907 | Newton | 241/301 |
| 996,916 | A * | 7/1911 | Fay | 366/197 |
| 1,090,567 | A * | 3/1914 | Roberts | 366/276 |
| 1,244,956 | A * | 10/1917 | Clanton | 74/665 K |
| 1,458,282 | A * | 6/1923 | Fairbanks | 366/289 |
| 2,146,533 | A * | 2/1939 | Erickson | 414/520 |
| 2,209,287 | A | 7/1940 | Simpson | |
| 2,269,736 | A | 1/1942 | Rogers | |
| 2,376,722 | A | 5/1945 | Podell | |

(Continued)

FOREIGN PATENT DOCUMENTS

EP 0 394 087 A1 10/1990

OTHER PUBLICATIONS

International Search Report, dated Nov. 26, 2009, from corresponding PCT application, 2 pages.

*Primary Examiner* — Tony G Soohoo

(74) *Attorney, Agent, or Firm* — Young & Thompson

(57) ABSTRACT

A stirrer device (1*a*, 1*b*) includes at least one shaft (13), a first blade-type stirrer assembly (3) and a second blade-type stirrer assembly (2), characterized in that the blade-type stirrer assemblies are movable relative to each other in the axial direction. Also provided is a method of adjusting the above stirrer device.

20 Claims, 4 Drawing Sheets

(56) References Cited

U.S. PATENT DOCUMENTS

| | | | | | |
|---|---|---|---|---|---|
| 3,357,685 | A | * | 12/1967 | Stephens | 366/282 |
| 3,578,876 | A | * | 5/1971 | Stratienko | 416/121 |
| 5,013,158 | A | * | 5/1991 | Tarlow | 366/251 |
| 5,482,370 | A | | 1/1996 | Dedoes | |
| 5,613,425 | A | * | 3/1997 | Krznaric | 99/348 |
| 5,861,121 | A | * | 1/1999 | Heaslip et al. | 266/45 |
| 6,616,318 | B1 | * | 9/2003 | LeBlanc et al. | 366/129 |
| 2005/0094487 | A1 | | 5/2005 | Mussatto | |
| 2011/0026360 | A1 | * | 2/2011 | Greller et al. | 366/308 |

* cited by examiner

STIRRER DEVICE AND A METHOD OF ADJUSTING IT

BACKGROUND OF THE INVENTION

The present invention relates to a stirrer device and to a method of adjusting it.

The present invention relates in particular to a device for stirring a can of paint suitable for can depths corresponding to capacities of 0.5 liters (L) and 1 L and that can be placed in stirring cabinets in which the cans of paint are placed on a shelf or suspended by their lid.

DESCRIPTION OF THE RELATED ART

In the field of manufacture of paint on an industrial scale, for example for painting automobile vehicle bodywork, there are thousands of paint color references. Thus to reproduce one of them it is necessary to store and mix base colors, of which there are around 100. These base colors are contained in 0.5 L to 4 L cans, 0.5 L and 1 L cans being most commonly used. To keep the paint ready for use, cans containing the base colors are disposed in stirring cabinets adapted to stir the paint several times a day. As the person skilled in the art knows, these cabinets are of two sorts.

There are cabinets known as "standing can" cabinets in which the cans of paint are disposed on the upper surface of a shelf and others known as "suspended can" cabinets in which the cans of paint are suspended in the cabinet by their lid.

The cans of paint suitable for these types of cabinet generally comprise a cylindrical pot closed by a lid that is preferably provided with a handle. A shaft passes through the lid and has in its upper portion guide means that may be either a drive fork for standing cans or a drive gear for suspended cans. The shaft carries a stirrer blade and is adapted to drive it in rotation via the drive fork or the drive gear, thus making it possible to stir the paint contained in each pot in the stirring cabinet. The lid may be fitted to cans with different diameters.

With standing cans, the lid is movable in translation relative to the shaft, which makes it possible to fit it to cans with different depths (corresponding to capacities of 0.5 L and 1 L, for example). The dimensions of the blade or blades are limited by the dimensions of the smallest can. In a can of greater capacity the blade or blades may be insufficient for good stirring. One known solution to this problem is to use different stirrer devices for cans of different depths.

With suspended cans, the blade or blades are movable in translation relative to the shaft, which makes it possible to fit cans with different depths (corresponding to capacities of 0.5 L and 1 L, for example). Once again, the dimensions of the blade or blades are limited by the dimensions of the smallest can. In a can of larger size, the blade or blades may be insufficient for good stirring. Consequently, the same problem of imperfect stirring is encountered in large cans.

Document EP 0 394 087 describes a stirrer lid for standing cans of automobile bodywork paint including a rotary stirring shaft fitted with a stirrer blade. The stirrer blade is movable in the axial direction. As shown in FIGS. 1*b* and 1*a* in particular, it is mounted to slide on a small portion of the shaft.

The device from EP 0 394 087 cannot be fitted to 0.5 L and 1 L paint cans. The short travel in translation of the blade makes it unsuitable for 0.5 L paint cans and for paint cans of twice the volume, i.e. 1 L cans. The blade is either too large to enter a 0.5 L pot or too small for good stirring and homogenization of paint in a 1 L pot.

This device is no better suited to standing can stirring cabinets.

Other documents, such as U.S. Pat. Nos. 2,376,722 and 2,209,287, describe blades that are adjustable in position along a screw axis. However, once its position has been adjusted, each such blade is immobilized in the axial direction, with the result that it is necessary for the operator to know beforehand the position to be adopted for each of the blades and to intervene manually to adjust the blades and immobilize them in a given position.

SUMMARY OF THE INVENTION

An object of the present invention is to propose a new stirrer device free of some or all of the drawbacks referred to above. In particular, the present invention aims to propose a stirrer device that automatically fits cans with different depths corresponding to capacities of 0.5 L or 1 L and ensures good stirring in the largest cans.

To this end, the invention provides a stirrer device including at least one shaft, a first blade-type stirrer assembly and a second blade-type stirrer assembly, each blade-type stirrer assembly including a blade body directly or indirectly mounted on and constrained to rotate with said shaft, each blade body carrying at least one blade, said first and second stirrer assemblies being axially movable relative to each other, characterized in that the blade body of the second stirrer assembly is permanently mounted on the blade body of the first stirrer assembly so as to nest freely and telescopically between at least two positions, a close-together position corresponding to a short configuration in which the blade bodies of the stirrer assemblies are close together in the axial direction and a spaced-apart position corresponding to a long configuration in which the blade bodies of the stirrer assemblies are spaced apart from each other in the axial direction, at least the extreme spaced-apart position being defined by an abutment.

The expression blade-type stirrer assembly refers to stirrer assemblies comprising one or more blades.

Because blade-type stirrer assemblies may be driven continuously in axial relative movement because they are nested and able to slide freely, blade-type stirrer assemblies may, by virtue only of their own weight, be automatically positioned relative to each other in different positions corresponding to different can depths (for example 0.5 L and 1 L can depths), to ensure good stirring over the entire height of the can. Furthermore, it is possible to vary the relative position of the blades from one stirrer assembly to another. Finally, because they are nested and able to slide freely (telescopically), it is possible to increase the range of variation of the distance between the blades.

Each of the blade-type stirrer assemblies is preferably also movable axially relative to the shaft. Such a stirrer device design makes it possible to increase the range over which the relative position of the stirrer assemblies may be varied.

The extreme close-together and spaced-apart positions between which the first and second stirrer assemblies are movable axially are preferably defined by abutments.

Advantageously, the blade-type stirrer assembly has intermediate configurations in which the blades are further apart than in the short configuration and less far apart than in the long configuration.

The blade body of the second stirrer assembly is preferably a tube slotted over part of its length, the slot forming an opening in which the blade of the first stirrer assembly moves on axial relative movement of the first and second stirrer assemblies. Thus it is possible to obtain a short configuration in which the blades are extremely close together.

The abutment defining said extreme spaced-apart position is preferably formed by the closed end of said opening in the blade body of the second stirrer assembly, said closed end being adapted to abut against the area of connection of the blade of the first stirrer assembly with the corresponding blade body.

The abutment defining said extreme close-together position is preferably formed by an end of travel notch at the same end of the blade body of the second stirrer assembly as the closed end of the slot in which the blade of the first stirrer assembly travels, said notch being adapted to abut against a lug disposed at or in the vicinity of one end of the blade body of the first stirrer assembly.

In the short configuration, the two blade bodies preferably at least partially overlap the shaft.

In a first embodiment, in the long configuration, at least one of the blade bodies is in line with the shaft.

This first embodiment makes it possible to fit the stirrer device to a suspended can in a stirring cabinet.

In a second embodiment, in the long configuration, the blade bodies surround said shaft This second embodiment makes it possible to fit the stirrer device to a standing can in a stirring cabinet.

According to one feature of the invention, the blade body of the second stirrer assembly is nested telescopically on the blade body of the first stirrer assembly.

The first stirrer assembly is advantageously adapted to assume at least two different axial positions relative to said shaft and said device advantageously includes retaining means for retaining the first blade-type stirrer assembly relative to the shaft in at least one of said two different axial positions.

In the second embodiment, in which said shaft is vertical and said at least two axial positions assumed by the first stirrer assembly are referred to as a high position and a low position, the retaining means include two grooves in the internal wall of the blade body of the first stirrer assembly, said grooves being of different lengths and spaced angularly to cooperate selectively with an abutment on said shaft to enable the first blade-type stirrer assembly to move between the high position and the low position.

In the first embodiment, in which said shaft is vertical and said at least two axial positions assumed by the first stirrer assembly are referred to as a high position and a low position, the retaining means include a groove in the internal wall of the blade body of the first stirrer assembly, said groove being adapted to cooperate with an abutment on said shaft to enable movement between the high position and the low position.

In the first embodiment, this abutment is at the level of or in the vicinity of the lower end of the shaft.

In the second embodiment, this shaft abutment is at a distance from the lower end of the shaft.

The invention also provides a method of adjusting a stirrer device of the invention adapted to stir liquids contained in cans of varying height.

In a first implementation, when said device is mounted in a can of different height, the movement of the first stirrer assembly relative to the shaft between the high position and the low position is effected automatically, simply by the first stirrer assembly sliding along the shaft.

In the second implementation of the invention, the method includes the following steps:

removing the stirrer device from a first can containing a liquid to be mixed, the first stirrer assembly being in the high or low position relative to the shaft;

imparting axial and angular relative movement to the first blade-type stirrer assembly to go from a high position to a low position or vice-versa;

placing the stirrer device in another can of height that corresponds to the adjusted high or low position of the stirrer device.

The invention can be better understood and other objects, details, features, and advantages of the invention become more clearly apparent in the course of the following description with reference to the appended drawings of two particular embodiments of the invention provided by way of illustrative and non-limiting example only.

BRIEF DESCRIPTION OF THE DRAWING FIGURES

Figure 6:
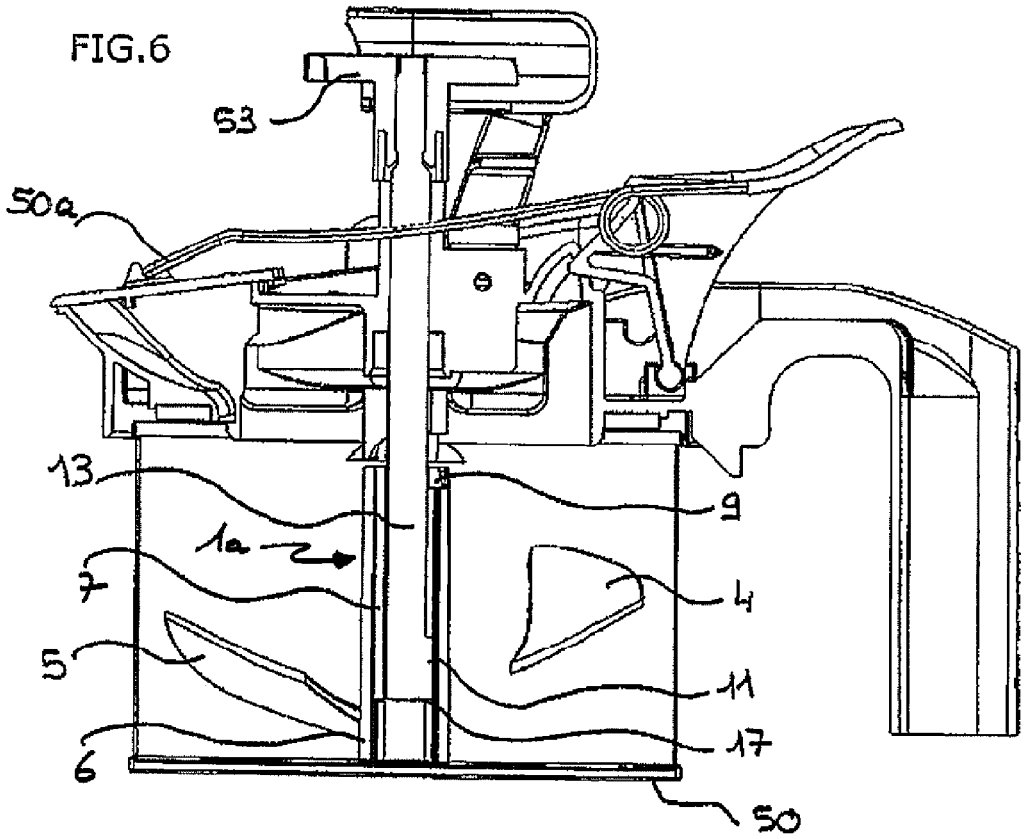
Figure 7:
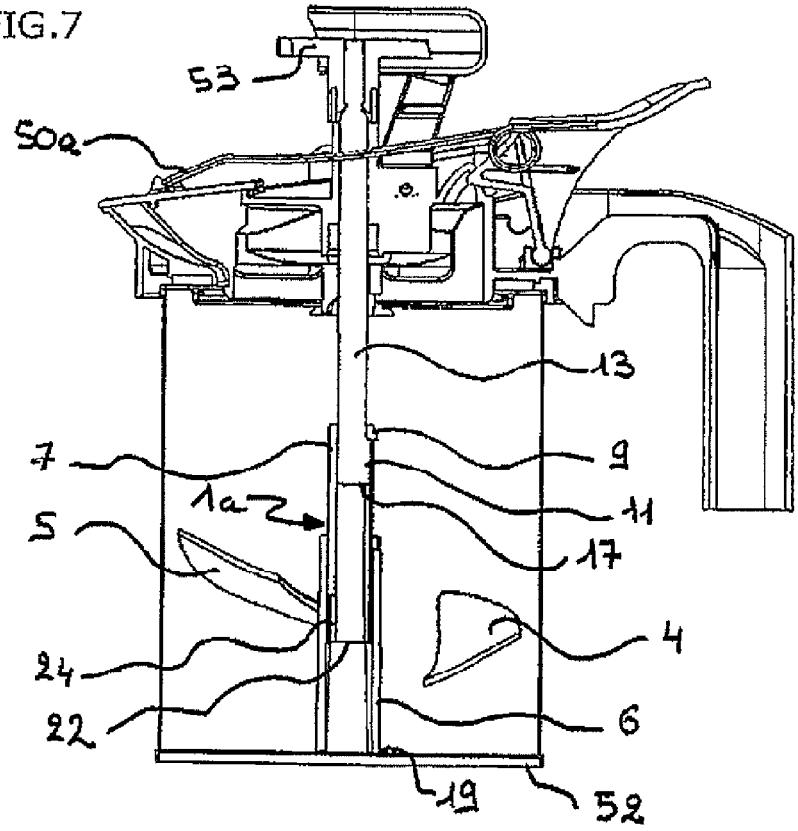
Figure 8:
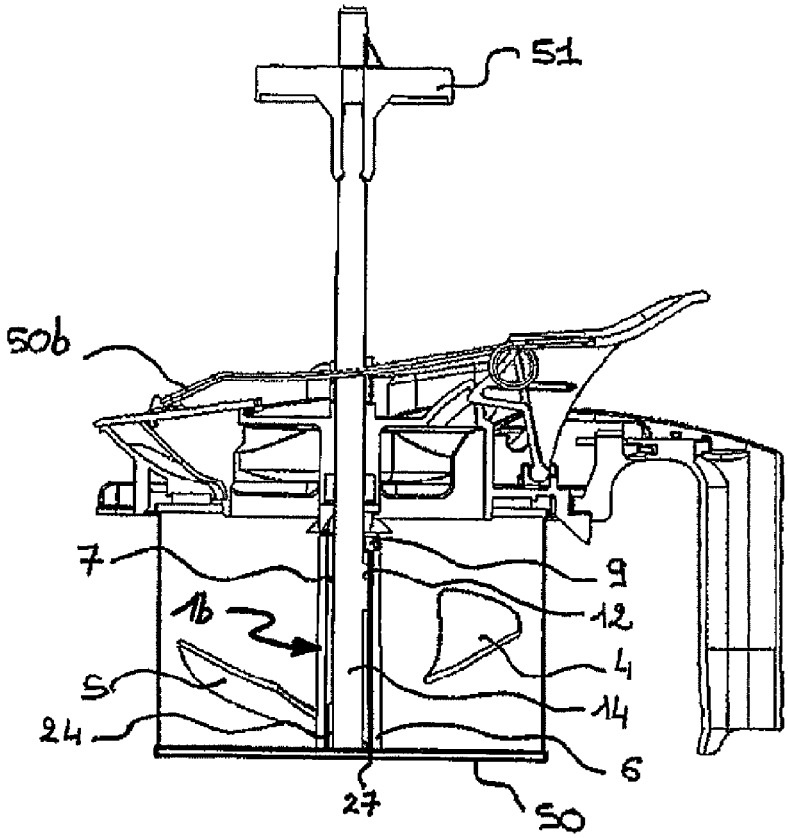
Figure 9:
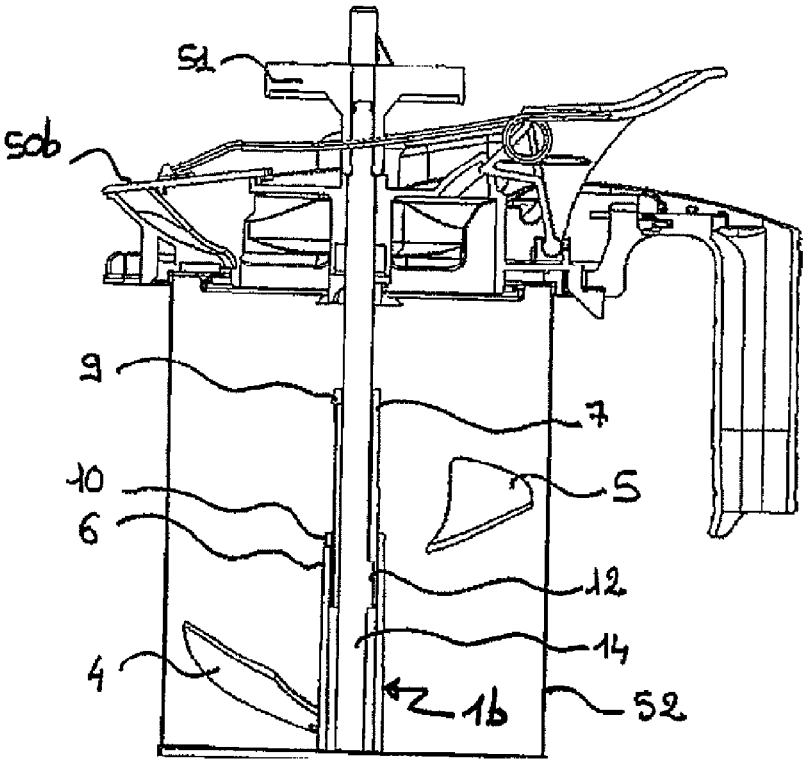

FIGS. 6 and 7 respectively show a stirrer device of the first embodiment in a short configuration and a long configuration; and FIGS. 8 and 9 respectively show in a short configuration and a long configuration a stirrer device of the second embodiment intended in particular for standing cans.

DETAILED DESCRIPTION OF THE INVENTION

Figure 1:
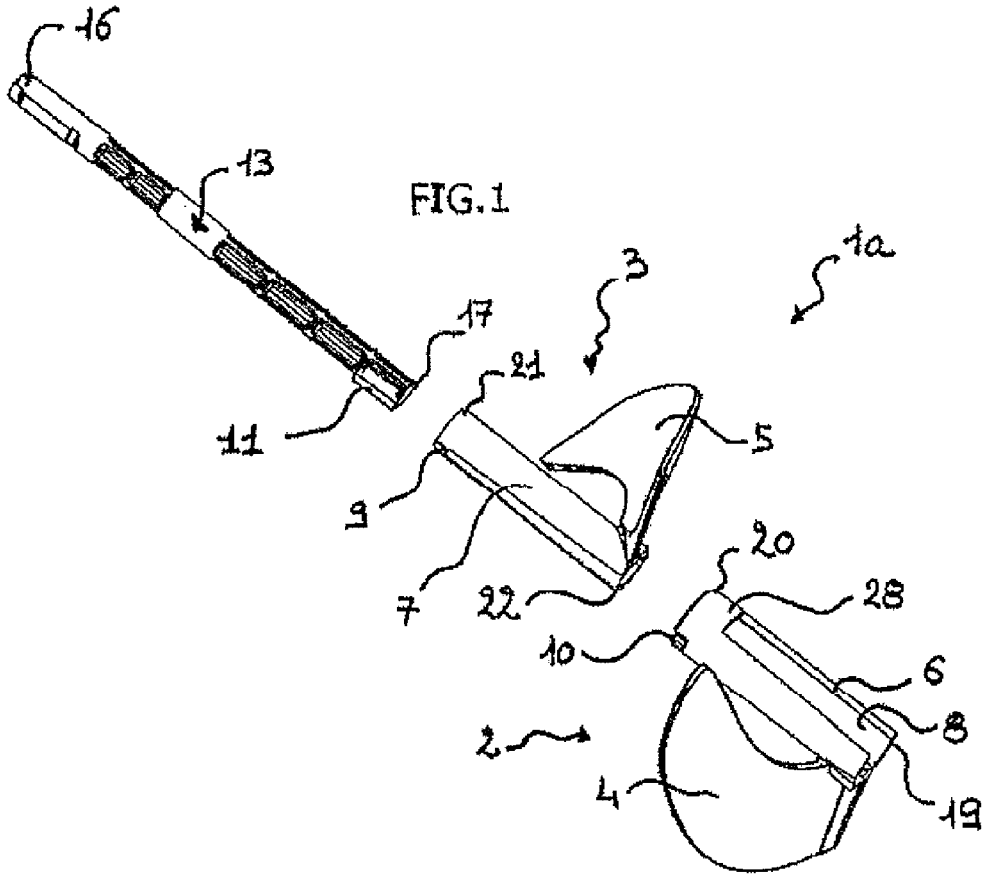
FIG. 1 is an exploded perspective view of a stirrer device of one embodiment of the present invention, intended in particular for suspended cans.
Figure 2:
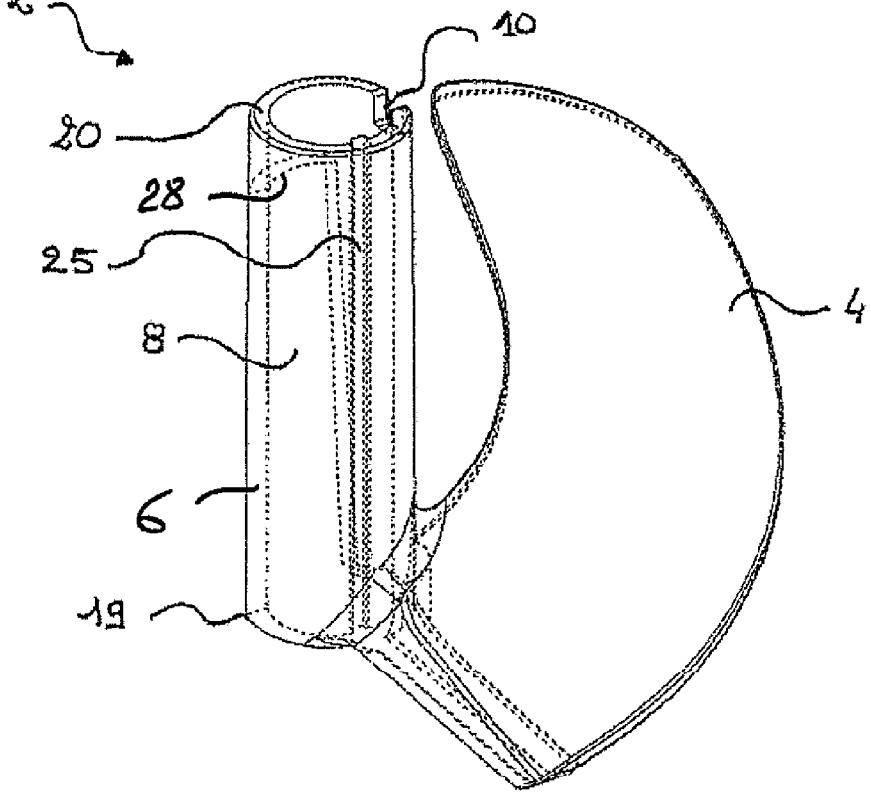
FIG. 2 is a perspective view of the lower blade of the FIG. 1 stirrer device.
Figure 3:
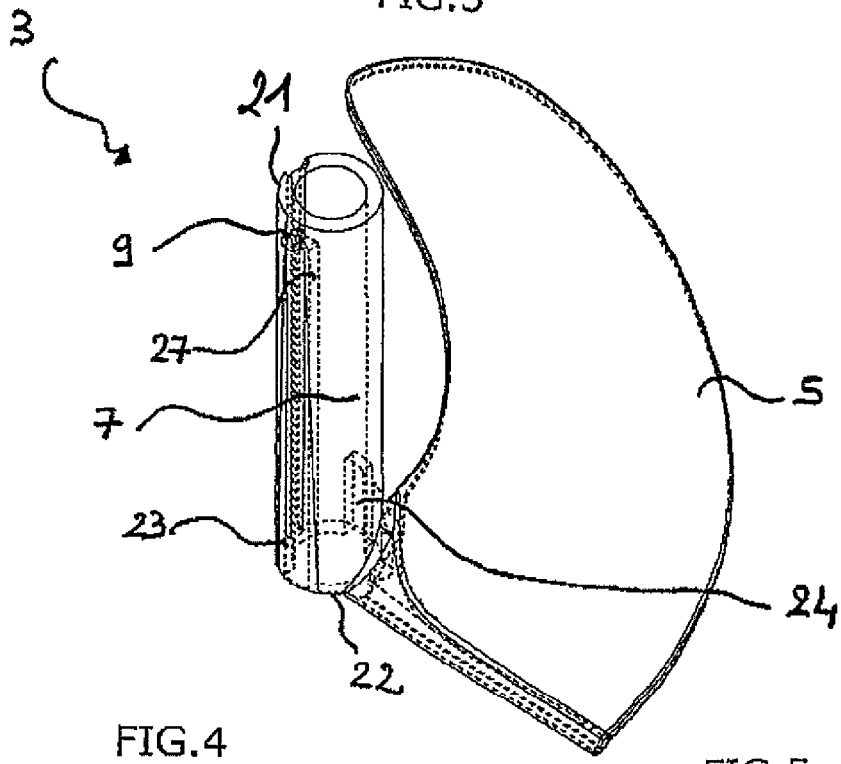
FIG. 3 is a perspective view of the upper blade of the FIG. 1 stirrer device.
Figure 4:
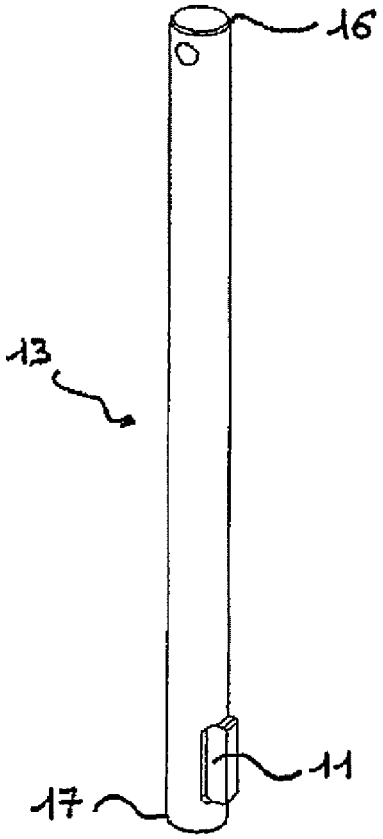
FIG. 4 is a perspective view of the shaft of the FIG. 1 stirrer device.

FIGS. 1 and 6 show a stirrer device 1*a* of a first embodiment of the invention. As indicated above, the stirrer device 1*a* shown in these figures fits cans suspended by their lid in a stirring cabinet.

The stirrer device 1*a* includes a lid 50*a* adapted to close a can 50, a shaft 13 passing through the lid 50*a*, two blade-type stirrer assemblies 2, 3 carried by the shaft 13 on one side of the lid 50*a*, and a drive gear 53 carried by the shaft on the other side of the lid 50*a*.

The shaft 13 has an abutment 11 at its lower end 17, the other end 16 of the shaft 13 carrying the drive gear 53 so that the shaft 13 may be driven in rotation thereby.

As indicated above, the stirrer device 1*a* also includes two blade-type stirrer assemblies, an upper blade-type stirrer assembly 3 and a lower blade-type stirrer assembly 2.

The blade-type stirrer assemblies 2 and 3 are movable relative to each other to nest telescopically and are also movable relative to the shaft 13.

To this end, the upper blade-type stirrer assembly 3 includes an upper blade body 7 of the hub type and of tubular, preferably substantially cylindrical, shape, and an upper blade 5. This upper blade 5 is radially connected to the upper blade body 7. Similarly, the lower blade-type stirrer assembly 2 includes a tubular lower blade body 6 of the hub type, preferably of substantially cylindrical shape, and a lower blade 4, said blade 4 being radially connected to the lower blade body 6. As shown in FIG. 1, the lower blade body 6 and the upper blade body 7 are coaxial with the shaft 13, and the lower blade body 6 can be nested inside the upper blade body 7. More particularly, the upper blade body 7 is adapted to surround the shaft 13 and the lower blade body 6 is adapted to surround the upper blade body 7.

The blade-type stirrer assemblies 3 and 2 may thus adopt a plurality of configurations as a function of the required position of one blade relative to the other, i.e. a short configuration, a long configuration or an intermediate configuration. In the short configuration, the upper and lower blade bodies overlap to the maximum. Thus in the short configuration the area of overlap of the upper and lower blade bodies has a length parallel to the longitudinal axis of said bodies that is greater than the length of the overlap area in the long configuration, in which these same bodies have minimum overlap. In this long configuration, the upper end of the lower blade body overlaps the lower end of the upper blade body when said body is vertical. Because the lower blade body 6 nests on and slides freely on the other blade body, in the vertical position of the shaft 13 the lower blade body 6 may move from the short configuration to the long configuration under its own weight.

As shown in FIG. 6, in the short configuration the upper blade 5 and the lower blade 4 are at substantially the same level in the axial direction. Similarly, in the short configuration the lower blade body 6 overlaps virtually all of the length of the upper blade body 7 and both at least partly overlap the shaft 13. In this configuration, the upper stirrer assembly 3 is in what is referred to as a high position relative to the shaft 13.

In an intermediate configuration shown in FIG. 7 close to the long configuration, the blades 5 and 4 are spaced apart from each other in the axial direction and the two blade bodies 6 and 7 are in line with the shaft 13. As shown in FIG. 7, in this configuration the upper stirrer assembly 3 is in what is referred to as a low position relative to the shaft 13.

In each of the long and short configurations the blade-type stirrer assemblies 3 and 2 are generally abutted against each other. In some circumstances, they may not be abutted, in particular when the stirrer assemblies are in intermediate configurations.

In intermediate configurations the blades 4 and 5 are farther apart than in the short configuration but less far apart than in the long configuration.

The lower blade body 6 includes a longitudinal opening 8 over virtually all its length, with the exception of a portion at its upper end 20 forming the closed end 28 of the opening 8. Thus in the long configuration the portion of the upper blade 5 connected to the upper blade body 7 is able to pass through the opening 8 and abut against the closed end 28.

The lower blade body 6 includes a longitudinal rib 25 on its internal wall adapted to cooperate with a longitudinal groove 23 in the external wall of the upper blade body 7. The longitudinal rib 25 and the groove 23 prevent relative rotation of the blade-type stirrer assemblies 2 and 3. Consequently, when driven in rotation by the drive gear 53, the shaft 13 drives in rotation the upper blade-type stirrer assembly 3, which in turn drives the lower blade-type stirrer assembly 2.

Also, the lower blade body 6 includes an end-of-travel notch 10 at its upper end 20. This notch 10 is adapted to receive a lug 9 on the upper end 21 of the upper blade body 7. The lug 9 is adapted to abut in the end-of-travel notch 10, forming a short configuration abutment of the stirrer assembly. Note that during assembly of the stirrer device 1*a*, the upper stirrer assembly 3 may simply be pressed into the lower stirrer assembly 2, temporary deformation of the blades enabling the lug 9 to pass the end 20 of the lower blade 2.

Finally, the internal wall of the upper blade body 7 includes two diametrically opposite grooves. One groove 27 extends longitudinally from the lower end 22 of the upper blade body 7 practically as far as, but without reaching, the upper end 21 of said upper blade body 7. The other groove 24 on the internal wall of the blade body 7 extends longitudinally from the lower end 22 over a shorter distance, generally substantially equal to the length of the abutment 11. Alternatively, the grooves 24 and 27 may be offset angularly by an angle other than 180° as a function of their width.

However, in this first embodiment, corresponding to the stirrer device 1*a*, only the groove 27 cooperates with the abutment 11 of the shaft 13. Accordingly, in the long configuration, the abutment 11 is at the maximum travel end of the groove 27, the lower stirrer assembly 2 abuts against the closed end 28, and the upper blade 5 is spaced apart from the lower blade 4. The upper stirrer assembly 3 is thus in the low position relative to the shaft 13. In the short configuration, the lug 9 abuts in the end of travel notch 10 and the upper blade 5 is at the same level as the lower blade 4, in other words the upper stirrer assembly 3 is in the high position relative to the shaft 13. When the stirrer assemblies 2 and 3 are in intermediate positions they are not in abutting engagement.

The blades are therefore movable relative to the shaft 13, which makes it possible for them to fit in cans with different depths. The groove 24 is necessary only for the second embodiment described below.

The operation of the stirrer device of the first embodiment is described below with reference to FIGS. 6 and 7.

FIGS. 6 and 7 show a device of the invention comprising a lid 50*a* adapted to close a paint pot 50 or 52. This lid includes a drive gear 53 connected to the shaft 13.

In FIG. 6, the stirrer device 1*a* is positioned in a shallow can, such as a 0.5 L can. The blade-type stirrer assemblies 2 and 3 are thus in the short configuration, i.e. they are entirely inside the pot, which may be closed by the lid 50*a*. In this short configuration the blades 4 and 5 are at substantially the same level in the axial direction and the two blade bodies 7 and 6 cover the shaft 13. To this end, the abutment 11 is inserted into the groove 27 of the upper blade body 7. The stirrer assembly 3 is in the upper position relative to the shaft 13. The lower blade body 6 slides along the upper blade body 7, the rib 25 cooperating with the rib 23, until it reaches the bottom of the paint pot.

In FIG. 7, the stirrer device 1*a* is in a pot that is deeper than the FIG. 6 pot, such as a 1 L pot. As represented in this figure, the stirrer assemblies 2 and 3 are in an intermediate configuration close to the long configuration. In this configuration the blades 4 and 5 are spaced apart from each other in the axial direction and the blade bodies 7 and 6 are in line with the shaft 13, although without the upper blade 5 abutting against the closed end 28 of the opening 8 (as would happen in the long configuration). The upper stirrer assembly 3 is in the low position relative to the shaft 13.

The user of the stirrer device need do nothing to go from the short configuration to the long configuration. The lower stirrer assembly 2 descends under its own weight until it touches the bottom of the deeper can.

The stirrer device 1*b* of the second embodiment is described below. The second embodiment corresponds to a stirrer device suitable for stirring standing cans in a stirring cabinet.

Thus the stirrer device 1*b* includes a lid 50*b* adapted to close a can 50 or 52, a shaft 14 passing through the lid 50*b*, and two blade-type stirrer assemblies 2, 3 identical to those of the first embodiment and consequently bearing the same references. The shaft 14 carries the blade-type stirrer assemblies 2, 3 on one side of the lid 50*b* and the shaft 14 carries a drive fork 51 (or other drive means) on the other side of the lid 50*b*.

This second embodiment differs little from the first embodiment described above except that the device 1*b* includes a shaft 14 that is a different shape to the shaft 13.

In this embodiment, the blade-type stirrer assemblies 2 and 3 are also movable relative to the shaft 14 and relative to each other to nest telescopically.

The blade bodies 7 and 6 are coaxial with the shaft 14, with the result that the lower blade body 6 is adapted to nest in the upper blade body 7. More particularly, the upper blade body 7 is adapted to surround the shaft 14 and the lower blade body 6 is adapted to surround the upper blade body 7.

The blade-type stirrer assemblies 3 and 2 also assume a plurality of configurations as a function of the position of one blade relative to the other, i.e. a short configuration, a long configuration or intermediate configurations.

As shown in FIG. 8, in the short configuration the upper blade 5 and the lower blade 4 are at substantially the same level in the axial direction and the lower blade body 6 overlaps virtually all of the length of the upper blade body 7 and both of them overlap the shaft 14. Moreover, in the short configuration, the lug 9 abuts against the end of travel notch 10. As indicated in FIG. 8, the upper stirrer assembly 3 is in the low position relative to the shaft 14.

In the long configuration, the blades 5 and 4 are spaced apart from each other in the axial direction and the two blade bodies 6 and 7, which overlap only partially over a length less than the overlap length in the short configuration, overlap the shaft 14. Moreover, in the long configuration, an abutment 12 of the shaft 14 abuts in the small groove 24, of length that is substantially equal to the length of the abutment 12, and the upper blade 5 abuts against the closed end 28 of the blade body 6. As shown in FIG. 7, the upper stirrer assembly 3 is in the high position relative to the shaft 14.

Thus the blades 3 and 2 are preferably abutted against each other in each of the long and short configurations. As in the first embodiment, they need not be in abutting engagement in some situations, notably when the blades are in intermediate configurations. The short configuration abutment may also be dispensed with.

In the intermediate configurations the blades 4 and 5 are farther apart than in the short configuration but less far apart than in the long configuration.

Figure 5:
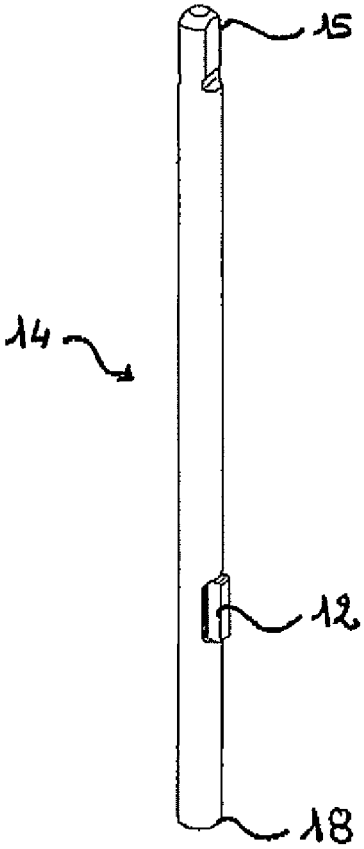
FIG. 5 is a perspective view of a shaft of the stirrer device of a second embodiment of the present invention.

As shown in FIG. 5, for the blades to assume these configurations the shaft 14 has a length generally greater than the length of the shaft 13 of the first embodiment. The lower end 18 of the shaft 14 touches the bottom of the paint pot into which the shaft 14 is inserted whether in the short or the long configuration. The upper end 15 of the shaft 14 is connected to the drive fork 51 (FIGS. 8 and 9). To this end, a portion of the shaft passes through the lid 50*b*. Moreover, to make it possible to assume these configurations the shaft 14 includes an abutment 12 that is not situated at its lower end 18 but at a distance therefrom.

As indicated above, the abutment 12 of the shaft 14 is accommodated either in the groove 24 of the upper blade body 7 so that the blade-type stirrer assemblies 2 and 3 are in the long configuration or in the groove 27 so that the blade-type stirrer assemblies 2 and 3 are in the short configuration (FIG. 8). Consequently, in order to go from one configuration to another, an additional manipulation is required compared to the first embodiment, because it is necessary to insert the abutment 12 into the groove 24 (long configuration) or into the groove 27 (short configuration). In other words, given that these two grooves are diametrically opposite, an angular offset of the order of 180° is necessary to change from one configuration to the other.

In both embodiments the blades 2 and 3 and the shafts 13 and 14 are molded from plastic material. The shafts 13 and 14 may equally be produced in other materials, for example stainless steel.

The operation of the stirrer device of the second embodiment is described below with reference to FIGS. 8 and 9.

FIGS. 8 and 9 show the stirrer device 1*b* including the lid 50*b* adapted to close the paint pot 50 or 52.

FIG. 8 shows the stirrer device 1*b* with the blade-type stirrer assemblies 2 and 3 in the short configuration so that they fit inside a shallow can, such as a 0.5 L can. To this end, the abutment 12 for the shaft 14 is placed in the groove 27 so that the upper blade 5 and the lower blade 4 are at substantially the same level in the axial direction and the upper stirrer assembly 3 is therefore in the low position relative to the shaft 14. Accordingly, the lower blade body 6 overlaps entirely the length of the upper blade body 7 and both overlap the shaft 14. The lower end 18 of the shaft 14 touches the bottom of the paint can, like the ends 19 and 22 of the blade bodies 6 and 7, respectively. Thus the blade-type stirrer assemblies 2 and 3 extend over the same portion of the shaft 14.

FIG. 9 shows a device 1*b* with blade-type stirrer assemblies 2 and 3 in a long configuration. In this configuration the device 1*b* is suited to a deeper paint can and can homogenize the paint efficaciously. To this end, the blades 5 and 4 are spaced apart from each other in the axial direction and the two blade bodies 6 and 7 extend along said shaft 14, the lower end of the lower blade body 6 being positioned at the level of the lower end 18 of the shaft 14. Moreover, the upper blade 5 is abutted against the closed end 28 of the lower blade body 6.

The user of said device 1*b* must effect a preliminary operation to change from a short configuration to a long configuration. They must place the abutment 12, not in the groove 27, but in the small groove 24 of the upper blade body 7, so that the upper stirrer assembly 3 is in the high position relative to the shaft 14. This is necessary because, to stir a standing can in a stirring cabinet, the shaft is not suspended, i.e. it touches the bottom of the paint pot 52.

It suffices thereafter to replace the abutment 12 in the groove 27 to return the device 1*b* to the low position.

Although the invention has been described with reference to particular embodiments, it is clear that it is in no way limited thereto and encompasses all technical equivalents of the means described and combinations thereof within the scope of the invention.

Although not described above, the first blade-type stirrer assembly 3 could be fixedly mounted on the shaft and only the second stirrer assembly 2 movable axially relative to the shaft to vary the relative position of said stirrer assemblies.

The invention claimed is:

1. A stirrer device (1*a*; 1*b*) including:

at least one shaft (13; 14), a first blade-type stirrer assembly (3) and a second blade-type stirrer assembly (2), each blade-type stirrer assembly (2, 3) including a blade body (7, 6) directly or indirectly mounted on and constrained to rotate with said shaft (13; 14), each blade body (7, 6) carrying at least one blade (5, 4), said first and second stirrer assemblies (2, 3) being axially movable relative to each other, wherein the blade body (6) of the second stirrer assembly (2) is permanently mounted on the blade body (7) of the first stirrer assembly (3) so as to nest freely and telescopically with the blade body (7) of the first stirrer assembly between at least two positions, a close-together position corresponding to a short configuration in which the blade bodies (7, 6) of the stirrer assemblies (2, 3) are close together in the axial direction and a spaced-apart position corresponding to a long configuration in which the blade bodies (7, 6) of the stirrer assemblies (2, 3) are spaced apart from each other in the axial direction, at least the extreme spaced-apart position being defined by an abutment, and wherein the blade body (6) of the second stirrer assembly (2) and the blade body (7) of the first stirrer assembly (3) telescopically slide one inside another.

2. A stirrer device (1*a*, 1*b*) according to claim 1, wherein each of the blade-type stirrer assemblies (2, 3) is also movable axially relative to the shaft (13; 14).

3. A stirrer device (1*a*, 1*b*) according to claim 2, characterized in that the extreme close-together and spaced-apart positions between which the first and second stirrer assemblies (2, 3) are movable axially are defined by abutments.

4. A stirrer device (1*a*, 1*b*) according to claim 2, wherein, in the short configuration the two blade bodies (7, 6) at least partially overlap the shaft (13; 14).

5. A stirrer device (1*a*, 1*b*) according to claim 1, wherein the extreme close-together and spaced-apart positions between which the first and second stirrer assemblies (2, 3) are movable axially are defined by abutments.

6. A stirrer device (1*a*, 1*b*) according to claim 5, wherein, in the short configuration the two blade bodies (7, 6) at least partially overlap the shaft (13; 14).

7. A stirrer device (1*a*, 1*b*) according to claim 1, wherein the blade body (6) of the second stirrer assembly (2) is a tube slotted over part of its length, the slot forming an opening (8) in which the blade (5) of the first stirrer assembly (3) moves on axial relative movement of the first and second stirrer assemblies.

8. A stirrer device (1*a*, 1*b*) according to claim 7, wherein the abutment defining said extreme spaced-apart position is formed by the closed end (28) of said opening (8) in the blade body (6) of the second stirrer assembly (2), said closed end (28) being adapted to abut against the area of connection of the blade (5) of the first stirrer assembly (3) with the corresponding blade body (7).

9. A stirrer device (1*a*, 1*b*) according to claim 8, wherein the abutment defining said extreme close-together position is formed by an end of travel notch (10) at the same end (20) of the blade body (6) of the second stirrer assembly (2) as the closed end (28) of the slot in which the blade (5) of the first stirrer assembly (3) travels, said notch (10) being adapted to abut against a lug (9) disposed at or in the vicinity of one end (21) of the blade body (7) of the first stirrer assembly (3).

10. A stirrer device (1*a*, 1*b*) according to claim 9, wherein in the short configuration the two blade bodies (7, 6) at least partially overlap the shaft (13; 14).

11. A stirrer device (1*a*, 1*b*) according to claim 7, wherein, in the short configuration the two blade bodies (7, 6) at least partially overlap the shaft (13; 14).

12. A stirrer device (1*a*, 1*b*) according to claim 8, wherein, in the short configuration the two blade bodies (7, 6) at least partially overlap the shaft (13; 14).

13. A stirrer device (1*a*, 1*b*) according to claim 1, wherein, in the short configuration the two blade bodies (7, 6) at least partially overlap the shaft (13; 14).

14. A stirrer device (1*a*, 1*b*) according to claim 1, wherein, in the long configuration at least one of the blade bodies (7, 6) is in line with the shaft (13).

15. A stirrer device (1*a*, 1*b*) according to claim 1, wherein, in the long configuration the blade bodies surround said shaft (14).

16. A stirrer device (1*a*, 1*b*) according to claim 1, wherein the first stirrer assembly (3) is adapted to assume at least two different axial positions relative to said shaft (13; 14) and said device includes retaining means for retaining the first blade-type stirrer assembly (3) relative to the shaft (13; 14) in at least one of said two different axial positions.

17. A stirrer device (1*a*, 1*b*) according to claim 1, wherein, the blade body (6) of the second stirrer assembly (2) is a lower blade body (6) and the blade body (7) of the first stirrer assembly (3) is an upper blade body, and the lower blade body (6) and the upper blade body (7) are coaxial with the at least one shaft (13), and the lower blade body (6) is nested inside the upper blade body (7), with the upper blade body (7) surrounding the at least one shaft (13) and the lower blade body (6) surrounding the upper blade body (7).

18. A stirrer device (1*b*) including at least one shaft (13; 14), a first blade-type stirrer assembly (3) and a second blade-type stirrer assembly (2), each blade-type stirrer assembly (2, 3) including a blade body (7, 6) directly or indirectly mounted on and constrained to rotate with said shaft (13; 14), each blade body (7, 6) carrying at least one blade (5, 4), said first and second stirrer assemblies (2, 3) being axially movable relative to each other, wherein the blade body (6) of the second stirrer assembly (2) is permanently mounted on the blade body (7) of the first stirrer assembly (3) so as to nest freely and telescopically between at least two positions, a close-together position corresponding to a short configuration in which the blade bodies (7, 6) of the stirrer assemblies (2, 3) are close together in the axial direction and a spaced-apart position corresponding to a long configuration in which the blade bodies (7, 6) of the stirrer assemblies (2, 3) are spaced apart from each other in the axial direction, at least the extreme spaced-apart position being defined by an abutment, wherein the first stirrer assembly (3) is adapted to assume at least two different axial positions relative to said shaft (13; 14) and said device includes retaining means for retaining the first blade-type stirrer assembly (3) relative to the shaft (13; 14) in at least one of said two different axial positions, and of the type in which said shaft (14) is vertical, said at least two axial positions assumed by the first stirrer assembly (3) being a high position and a low position, characterized in that the retaining means include two grooves (24, 27) in the internal wall of the blade body (7) of the first stirrer assembly (3), said grooves (24, 27) being of different lengths and spaced angularly to cooperate selectively with an abutment (12) on said shaft (14) to enable the first blade-type stirrer assembly (3) to move between the high position and the low position.

19. A method of adjusting a stirrer device (1*b*) according to claim 18, said device being adapted to stir liquid contained in cans of varying height, characterized in that said method includes the steps of:

removing the stirrer device from a first can containing a liquid to be mixed, the first stirrer assembly being in the high or low position relative to the shaft (14);

imparting axial and angular relative movement of the first blade-type stirrer assembly (3) to go from a high position to a low position or vice-versa;

placing the stirrer device in another can of height that corresponds to the adjusted high or low position of the stirrer device.

20. A stirrer device (1*b*) including at least one shaft (13; 14), a first blade-type stirrer assembly (3) and a second blade-type stirrer assembly (2), each blade-type stirrer assembly (2, 3) including a blade body (7, 6) directly or indirectly mounted on and constrained to rotate with said shaft (13; 14), each blade body (7, 6) carrying at least one blade (5, 4), said first and second stirrer assemblies (2, 3) being axially movable relative to each other, wherein the blade body (6) of the second stirrer assembly (2) is permanently mounted on the blade body (7) of the first stirrer assembly (3) so as to nest freely and telescopically between at least two positions, a close-together position corresponding to a short configuration in which the blade bodies (7, 6) of the stirrer assemblies (2, 3) are close together in the axial direction and a spaced-apart position corresponding to a long configuration in which the blade bodies (7, 6) of the stirrer assemblies (2, 3) are spaced apart from each other in the axial direction, at least the extreme spaced-apart position being defined by an abutment, wherein the first stirrer assembly (3) is adapted to assume at least two different axial positions relative to said shaft (13; 14) and said device includes retaining means for retaining the first blade-type stirrer assembly (3) relative to the shaft (13; 14) in at least one of said two different axial positions, and of the type in which said shaft (13) is vertical, said at least two different axial positions assumed by the first stirrer assembly (3) being a high position and a low position, characterized in that the retaining means include a groove (27) in the internal wall of the blade body (7) of the first stirrer assembly (3), said groove (27) being adapted to cooperate with an abutment (11) on said shaft (13) to enable movement between the high position and the low position.

* * * * *